US008405312B2

(12) United States Patent
Kawasaki et al.

(10) Patent No.: US 8,405,312 B2
(45) Date of Patent: Mar. 26, 2013

(54) PLASMA DISPLAY PANEL AND METHOD OF MANUFACTURING THE SAME AND PLASMA DISPLAY DEVICE USING THE PLASMA DISPLAY PANEL

(75) Inventors: Tatsuhiko Kawasaki, Hitachinaka (JP); Masayuki Wada, Mito (JP); Atsuo Ohtomi, Hitachinaka (JP)

(73) Assignee: Hitachi Consumer Electronics Co., Ltd., Tokyo (JP)

( * ) Notice: Subject to any disclaimer, the term of this patent is extended or adjusted under 35 U.S.C. 154(b) by 740 days.

(21) Appl. No.: 12/545,958

(22) Filed: Aug. 24, 2009

(65) Prior Publication Data

US 2010/0079417 A1 Apr. 1, 2010

(30) Foreign Application Priority Data

Sep. 26, 2008 (JP) ..... 2008-248119

(51) Int. Cl.
*G09G 5/00* (2006.01)
*H01J 17/49* (2012.01)
*H01J 9/00* (2006.01)

(52) U.S. Cl. ..... 313/587; 313/582
(58) Field of Classification Search ..... 313/582–587; 445/24
See application file for complete search history.

(56) References Cited

U.S. PATENT DOCUMENTS

2006/0261738 A1* 11/2006 Ohtoh et al. ..... 313/586
2008/0007174 A1* 1/2008 Kim ..... 313/582
2009/0140652 A1 6/2009 Fukui et al.
2009/0146566 A1 6/2009 Fukui et al.
2010/0045573 A1 2/2010 Terauchi et al.

FOREIGN PATENT DOCUMENTS

JP 9-185945 7/1997
JP 09185945 A * 7/1997
JP 10-106441 4/1998
JP 10-334809 12/1998
JP 2006-059780 3/2006
JP 2007-48733 2/2007
JP 2008-181903 8/2008
WO WO 2008/047910 4/2008

* cited by examiner

*Primary Examiner* — Anh Mai
*Assistant Examiner* — Elmito Breval
(74) *Attorney, Agent, or Firm* — Antonelli, Terry, Stout & Kraus, LLP.

(57) ABSTRACT

Increase of an address voltage change amount of a PDP is suppressed. X and Y electrodes which are a display electrode pair arranged on a plate; a dielectric layer covering the X and Y electrodes; and a protective layer covering the dielectric layer are provided. The protective layer includes an MgO film deposited on a surface of the dielectric layer and a plurality of MgO crystalline particles attached on the MgO film. Also, by using (110) orientation as a crystal orientation of the MgO film, a crystal density of the MgO film can be increased, so that an increase of the address voltage change amount can be suppressed.

12 Claims, 10 Drawing Sheets

| | MgO FILM | | | DISCHARGE VOLTAGE | | |
|---|---|---|---|---|---|---|
| | ORIENTATION | PEAK INTENSITY RATIO ($P_{220}/P_{200}$) | Si CONCENTRATION (ppm) | Va1 | Va2 | ⊿Va (Va2−Va1) |
| EXAMPLE 1 | (110) | 0.5 | 458∼766 | 20.7 | 46.2 | 25.5 |
| EXAMPLE 2 | (110) | 0.75 | 458∼766 | 16.0 | 28.9 | 12.8 |
| EXAMPLE 3 | (110) | 1 | 458∼766 | 18.4 | 24.7 | 6.3 |
| EXAMPLE 4 | (110) | 0.5 | 150 OR LOWER | 17.7 | 27.5 | 9.8 |
| EXAMPLE 5 | (110) | 1 | 150 OR LOWER | 16.6 | 21.1 | 4.5 |
| COMPARATIVE EXAMPLE 1 | (111) | 0 | 150 OR LOWER | 22.1 | 29.9 | 7.8 |

*FIG. 10*

| | MgO FILM | | | DISCHARGE VOLTAGE | | |
|---|---|---|---|---|---|---|
| | ORIENTATION | PEAK INTENSITY RATIO ($P_{220}$ / $P_{200}$) | Si CONCENTRATION (ppm) | Va1 | Va2 | ⊿Va (Va2−Va1) |
| EXAMPLE 1 | (110) | 0.5 | 458～766 | 20.7 | 46.2 | 25.5 |
| EXAMPLE 2 | (110) | 0.75 | 458～766 | 16.0 | 28.9 | 12.8 |
| EXAMPLE 3 | (110) | 1 | 458～766 | 18.4 | 24.7 | 6.3 |
| EXAMPLE 4 | (110) | 0.5 | 150 OR LOWER | 17.7 | 27.5 | 9.8 |
| EXAMPLE 5 | (110) | 1 | 150 OR LOWER | 16.6 | 21.1 | 4.5 |
| COMPARATIVE EXAMPLE 1 | (111) | 0 | 150 OR LOWER | 22.1 | 29.9 | 7.8 |

*FIG. 12*

| | TARGET MATERIAL (MgO) | DEPOSITION CONDITION | MgO FILM | | |
|---|---|---|---|---|---|
| | Si CONCENTRATION (ppm) | WATER VAPOR PARTIAL PRESSURE (Pa) | ORIENTATION | PEAK INTENSITY RATIO ($P_{220}$ / $P_{200}$) | Si CONCENTRATION (ppm) |
| EXAMPLE 1 | 250~350 | 0.05 | (110) | 0.5 | 458~766 |
| EXAMPLE 2 | 250~350 | 0.07 | (110) | 0.75 | 458~766 |
| EXAMPLE 3 | 250~350 | 0.08 | (110) | 1 | 458~766 |
| EXAMPLE 4 | 50 OR LOWER | 0.05 | (110) | 0.5 | 150 OR LOWER |
| EXAMPLE 5 | 50 OR LOWER | 0.08 | (110) | 1 | 150 OR LOWER |
| COMPARATIVE EXAMPLE 1 | 50 OR LOWER | 0.0000745 | (111) | 0 | 150 OR LOWER |

*FIG. 13*

| | DISCHARGE GAS | DEPOSITION CONDITION | PROTECTIVE LAYER | | |
|---|---|---|---|---|---|
| | Xe CONCENTRATION (%) | WATER VAPOR PARTIAL PRESSURE (Pa) | ORIENTATION | MgO CRYSTAL PARTICLE | SPUTTERING RATE (RELATIVE VALUE) |
| EXAMPLE 5 | 18 | 0.08 | (110) | ATTACHED | 1.88 |
| COMPARATIVE EXAMPLE 1 | 18 | 7.448E-05 | (111) | ATTACHED | 2.86 |
| COMPARATIVE EXAMPLE 2 | 8 | 7.448E-05 | (111) | NOT ATTACHED | 1.00 |
| COMPARATIVE EXAMPLE 3 | 8 | 0.0175252 | (110) | NOT ATTACHED | 0.94 |
| COMPARATIVE EXAMPLE 4 | 8 | 0.0654 | (110) | NOT ATTACHED | 0.90 |
| COMPARATIVE EXAMPLE 5 | 8 | 0.08 | (111) | NOT ATTACHED | 0.75 |

PLASMA DISPLAY PANEL AND METHOD OF MANUFACTURING THE SAME AND PLASMA DISPLAY DEVICE USING THE PLASMA DISPLAY PANEL

CROSS-REFERENCE TO RELATED APPLICATION

The present application claims priority from Japanese Patent Application No. JP 2008-248119 filed on Sep. 26, 2008, the content of which is hereby incorporated by reference into this application.

BACKGROUND OF THE INVENTION

The present invention relates to a plasma display panel and a method of manufacturing the same. More particularly, the present invention relates to a technique effectively applied to a plasma display panel in which a plurality of MgO crystalline particles are attached on a surface of a protective film.

Plasma display panel (PDP) is a display panel which displays images by generating gas discharge in a discharge space called a cell in which a discharge gas such as rare gas is filled to excite a phosphor by vacuum ultraviolet rays generated by the gas discharge.

Currently, generally commercialized PDPs employing an AC (alternate current) driving method are surface discharge type. In the surface discharge type PDP, phosphors for color display can be arranged away from a display electrode pair toward a thickness direction of the panel, and characteristic degradation of the phosphors due to ion bombardment (sputtering) in discharge can be accordingly reduced. Therefore, the surface discharge type PDP is suitable for extending lifetime as compared with an opposed discharge type PDP in which display electrodes to be paired (called an X electrode and a Y electrode) are distributed to a front plate and a back plate.

In the generally used surface discharge type PDPs, a protective film for preventing a dielectric layer covering the display electrode pair from degradation due to ion bombardment in discharge is provided to a front plate. Also, the protective film has a function of protecting the dielectric layer from sputtering in discharge and a function of emitting secondary electrons by ion impact against the protective film to grow discharge.

As the protective film, a thin film of magnesium oxide (MgO) is generally used according to its ion bombardment resistance and easiness in secondary electron emission (for example, refer to Japanese Patent No. 3247632 (Patent Document 1)).

SUMMARY OF THE INVENTION

In a PDP, a predetermined frame time (field) is divided into a plurality of subfields, and grayscale display is performed by a combination of the number of times of sustain discharge (display discharge) caused in each subfield. Also, for forming images, an operation (address operation) for selecting a cell to be lightened (ON cell) is performed in each subfield. As the address operation, there are a select writing method of causing the display discharge in a cell to which the address discharge is generated and a select erasing method of causing the display discharge in a cell to which the address discharge is not generated. For example, in the select writing discharge, a pulse is applied to a scan electrode and an address electrode of a selected cell to generate the discharge (address discharge), so that wall charges are formed. And then, by applying a driving waveform to a cell group, an operation (sustain operation) for generating the sustain discharge (display discharge) in the selected cell is performed.

<Study on Discharge Delay>

The protective film of MgO mentioned above has a high secondary electron emission coefficient, and so it is effective for reducing a firing voltage. However, in recent years, there has been arising a necessity for further improving addressing speed along with demands for higher definition in PDPs. As a result, improvement of a discharge delay has been a new important issue.

The "discharge delay" is generally considered to be a sum of a formation delay and a statistic delay. The formation delay is a time period from a generation of initial electrons formed between electrodes to a formation of a distinct discharge, and it is taken as a substantially minimum discharge (firing) time in the case of causing discharges for multiple times. On the other hand, the statistic delay is a time period from a voltage application starting ionization to start of a discharge, and since variations in the discharge delay in each display cell is largely dominated by this time period, it is generally called "statistic delay".

If these discharge delays are long, an address time has to be extended to prevent display errors, and it leads to adverse effects such as shortened display period relating to image formation. Therefore, the discharge delay is preferred to be shortened for the PDP.

In a gas discharge, charged particles in a space (discharge space) are accelerated by an external electric field and bombarded against other gas molecules, so that the gas molecules are ionized to increase the number of ionized particles. Meanwhile, a discharge is not started unless charged particles are supplied at first, and the discharge start is delayed until charged particles are supplied. Therefore, as supplying more priming electrons (initial charged particles) to be pilot light (priming) of a discharge in the discharge space, the discharge delay is further shortened.

In current years, as means of supplying the number of the priming electrons in the discharge space, a structure in which single crystal MgO powder is attached on the protective film has been proposed. Although the principle of increase of the supplying amount of the priming electrons by adhesion of the single crystal MgO powder has not been completely figured out yet, improvement of the discharge delay has been experimentally confirmed.

<Study on New Issue Caused by Adhesion of Single Crystal MgO Powder)>

However, as the result studied by the present inventors, they have found that a new issue described below is caused in a PDP in which the single crystal MgO powder is attached on the protective film.

That is an issue that a variation of the address voltage to be an application voltage required for the address discharge is large. More particularly, in the address operation, the address voltage is applied to the address electrodes arranged along an extending direction of the display electrode pair in parallel. Meanwhile, one side of the plurality of display electrode pair configuring display lines of the PDP are called a scan electrode, and a scan pulse is applied to each scan electrode as sequentially scanning it in the address operation.

The address discharge is generated at a cell where the address electrode to which the address voltage is applied and the scan electrode to which the scan pulse is applied are intersected. Therefore, the address discharge is started by not only applying the address voltage to the address electrode but also applying the scan pulse, so that start timing of the address discharge is different depending on each display line.

Here, in the above-described PDP in which the single crystal MgO powder is attached on the protective film, it has been found out that a difference in requisite voltage amount (hereinafter, called address voltage change amount) between an address voltage applied in an initial stage of the address operation and an address voltage applied in a later stage of the address operation is significantly large.

In addition, it is found that the address voltage change amount also depends on temperature of the PDP, and the address voltage change amount increases as the temperature of the PDP increases.

When discharge error occurs in the address discharge, it causes display error, and therefore, the address voltage to be applied is set in accordance with a high-side voltage in the PDP having the increasing address voltage change amount. As a result, a margin for controlling the address voltage becomes narrow.

Also, increase of the address voltage causes increase of the power consumption of the PDP.

The present invention has been made in view of the above-described issue, and a preferred aim of the present invention is to provide a technique capable of suppressing the increase of the address voltage change amount of the PDP.

The above and other objects and novel characteristics of the present invention will be apparent from the description of the present specification and the accompanying drawings.

The typical ones of the inventions disclosed in the present application will be briefly described as follows.

That is a plasma display panel according to one embodiment of the present invention which includes a paired plate structures whose plates are opposed to each other so as to interpose a discharge space formed with filling a discharge gas therein, wherein one plate of the paired plate structures includes: a plurality of display electrode pairs arranged on the plate; a dielectric layer covering the plurality of display electrode pairs; and a protective layer covering the dielectric layer, the protective layer includes an MgO (magnesium oxide) film deposited on a surface of the dielectric layer and a plurality of MgO crystalline particles attached on the MgO film, and a crystal orientation of the MgO film is (110) orientation.

The effects obtained by typical aspects of the present invention disclosed in the present application will be briefly described below. Specifically, the increase of the address voltage change amount of the PDP can be suppressed.

BRIEF DESCRIPTIONS OF THE DRAWINGS

FIG. 10 is an explanatory diagram showing a measurement result of temperature dependency of an address discharge voltage in each example and a comparative example according to one embodiment of the present invention;

FIG. 12 is an explanatory diagram showing film formation conditions of the examples 1 to 5 and the comparative example 1 illustrated in FIG. 10;

FIG. 13 is an explanatory diagram showing change of a sputtering rate when each concentration of Xe gas is changed in the each PDP of the example and comparative examples according to one embodiment of the present invention;

DESCRIPTIONS OF THE PREFERRED EMBODIMENTS

Before describing the invention of the present application in detail, meanings of terms in the present application will be explained as follows.

A plasma display panel (PDP) is a display panel having a substantially plane plate shape in which gas discharge is generated within a discharge cell formed between paired plates which are oppositely arranged to excite phosphors by excitation light generated in the gas discharge, so that a desired image is formed. There are various configuration examples in an internal structure and a component material of the PDP depending on required performance or a driving method. However, all of these configuration examples are included except a configuration example which cannot be apparently employed in principle.

A plasma display module (PDP module) is a module having: a PDP; a chassis member which is arranged on opposite side of a display surface of the PDP for supporting the PDP; and a circuit board which is arranged on a back surface (surface positioned at opposite side of the opposed surface to the PDP) side of the chassis member and on which various electric circuits for driving and controlling the PDP or supplying power to the PDP are formed, wherein the various electric circuits and the PDP are electrically connected to each other. Note that, as an embodiment of the PDP module, there is also a structure that a part or all of the circuit board on which the various electric circuits are formed is not installed and an installing jig is formed on a designed installation position of the circuit board. In the present application, such an embodiment is also regarded as a PDP module.

A plasma display set (PDP set) is a display device in which the PDP module is covered by an external case. Also, such a display device is included in the PDP set in which the PDP module is fixed on a supporting structure such as, for example, a stand. Further, when the PDP set is used as a television receiver, the PDP and a tuner are electrically connected, and the one including the tuner is also regarded as the PDP set.

The above-described PDP module and PDP set are included in the plasma display device (PDP device).

In the embodiments described below, the invention will be described in a plurality of sections or embodiments when required as a matter of convenience. However, these sections or embodiments are not irrelevant to each other unless otherwise stated, and the one relates to the entire or a part of the other as a modification example, details, or a supplementary explanation thereof.

Also, components having the same function are denoted by the same reference symbols throughout the drawings for describing the embodiment, and the repetitive description thereof will be omitted. Hereinafter, embodiments of the present invention will be described in detail with reference to the accompanying drawings.

<Basic Structure of PDP>

Figure 1:
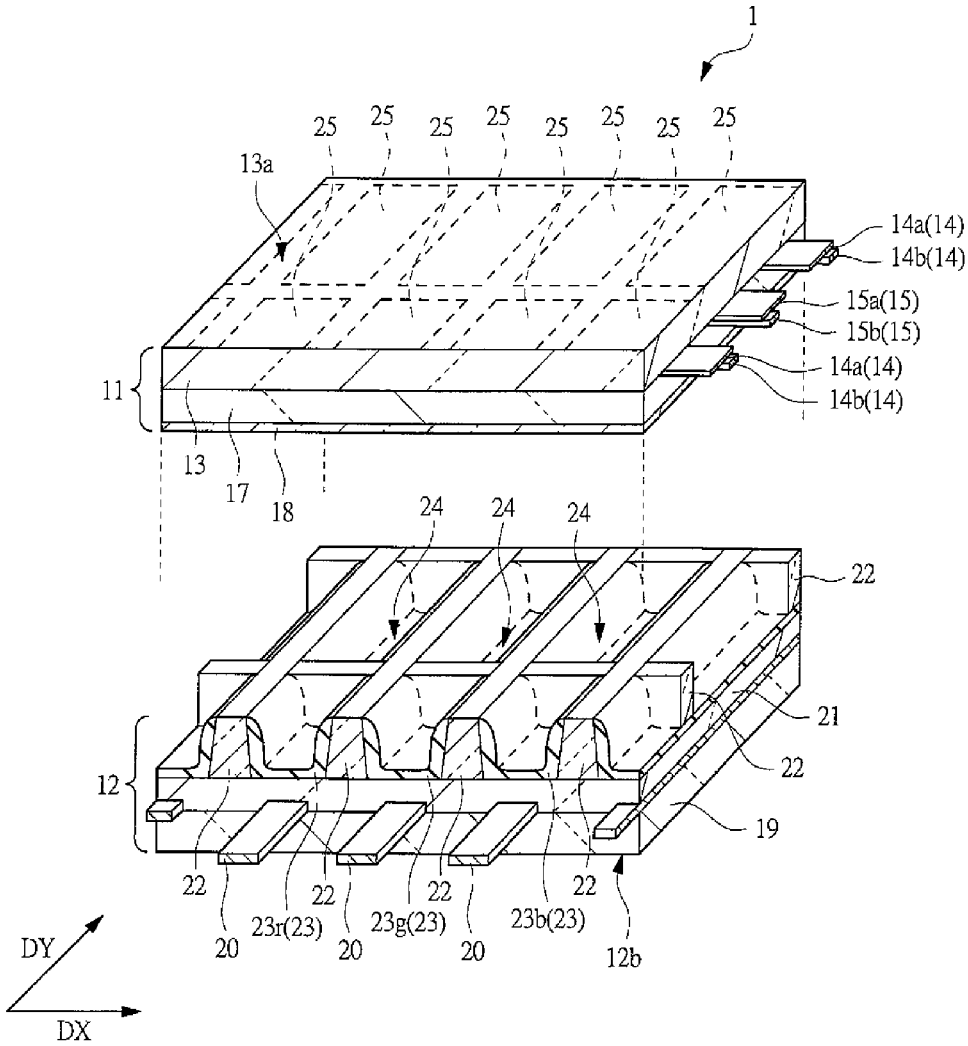
FIG. 1 is an enlarged assembly perspective view of a principal part illustrating an enlarged principal part of a PDP according to one embodiment of the present invention.
Figure 2:
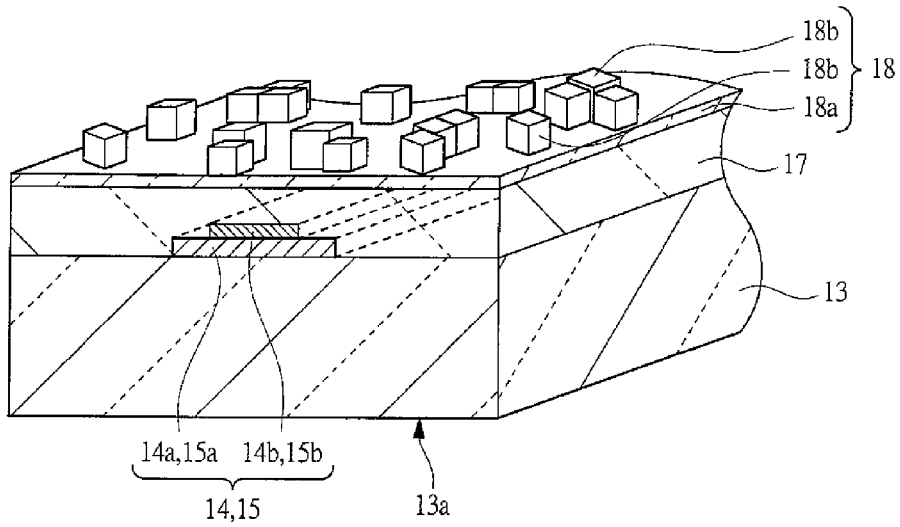
FIG. 2 is an enlarged assembly perspective view of the principal part illustrating a surface state of a protective layer as turning a front plate structure illustrated in FIG. 1 up side down.

First, one example of a PDP structure according to the present embodiment will be described as taking a three-electrode surface-discharge type PDP of AC driving type for color display as the example with reference to FIGS. 1 and 2. FIG. 1 is an enlarged assembly perspective view of a principal part illustrating as enlarging the principal part of the PDP according to the present embodiment, and FIG. 2 is an enlarged perspective view of the principal part illustrating a surface state of a protective layer as turning a front plate structure illustrated in FIG. 1 up side down.

In FIG. 1, a PDP 1 includes a front plate structure 11 and a back plate structure 12 which are paired plate structures which are opposed to each other so as to interpose a discharge space 24 formed with filling a discharge gas therein.

The front plate structure 11 includes: a plurality of X electrodes 14 and Y electrodes 15 forming a plurality of display electrode pairs arranged on a front plate (first plate) 13; a dielectric layer 17 covering these display electrode pairs; and a protective layer 18 covering the dielectric layer. Also, the protective film 18 includes an MgO (magnesium oxide) film 18*a* laminated on a surface of the dielectric layer 17 and a plurality of MgO crystalline particles 18*b* attached on the MgO film 18*a* as illustrated in FIG. 2.

The front plate structure 11 and the back plate structure 12 are combined so as to be arranged opposing each other, and the discharge space 24 is interposed therebetween. That is, the front plate structure 11 and the back plate structure 12 are oppositely arranged so as to interpose the discharge space 24.

The front plate structure 11 includes a front plate 13 formed of, for example, a glass plate, which has a first surface 13*a* to be the display surface of the PDP 1. On an opposite-side surface (inward surface) of the first surface 13*a* of the front plate 13, there are formed the plurality of X electrodes (display electrodes) 14 and Y electrodes (display electrodes and scan electrodes) 15 which are display electrodes of the PDP 1.

The X electrode 14 and the Y electrode 15 configure one display electrode pair for causing a sustain discharge (display discharge), and, for example, they are alternately arranged so as to extend in strip shape along a row direction DX. The paired X electrode 14 and Y electrode 15 configure a display line of the row direction DX in the PDP 1. Note that, although a part of the X electrode 14 and Y electrode 15 is illustrated as enlarging it in FIG. 1, the PDP 1 has the plurality of X electrodes 14 and Y electrodes 15 in accordance with the number of the rows of the display lines.

The X electrode 14 and the Y electrode 15 are generally configured with: an X transparent electrode 14*a* and a Y transparent electrode 15*a* which are made of, for example, a transparent electrode material such as ITO (Indium Tin Oxide) or $SnO_2$; and an X bus electrode 14*b* and a Y bus electrode 15*b* which are made of, for example, Ag, Au, Al, Cu, Cr, their stacked layer (for example, a stacked layer of Cr/Cu/Cr), or the like.

The X transparent electrode 14*a* and the Y transparent electrode 15*a* mainly contribute to the sustain discharge, and their light permeabilities are higher than those of the X bus electrode 14*b* and the Y bus electrode 15*b* for observing light emission of phosphors from the front plate 13 side. On the other hand, for carrying driving current through the X bus electrode 14*b* and the Y bus electrode 15*b* with low resistance, a metal material having a resistance lower than those of the X transparent electrode 14*a* and the Y transparent electrode 15*a* is used for the electrodes.

There is performed a process for forming the display electrode pair (X electrode 14 and Y electrode 15) on one of the surfaces (surface positioned at opposite side of the first surface 13*a*) of the front plate (first plate) 13, for example, as follows. That is, a thick film formation technique such as screen printing is used for the transparent material, Ag, or Au, and a thin film formation technique such as vapor deposition method or sputtering method and etching technique are used for other metals, so that the display electrode pair with a predetermined number of lines, thickness, width, and interval can be formed.

Although the X transparent electrode 14*a* and the Y transparent electrode 15*a* extending in strip shape are illustrated in FIG. 1, the electrode structures of the X transparent electrode 14*a* and the Y transparent electrode 15*a* are not limited to the shape. For example, for stabilizing the sustain discharge and improving the discharge efficiency, such a structure may be provided that protruding portions are formed such that the shortest distance (called discharge gap) between the paired electrodes comes shorter corresponding to the cell, from a position where the X bus electrode 14*b* is overlapped with the Y bus electrode 15*b* toward their facing direction. Also, various modification examples such as a straight shape, a T shape, or a ladder shape can be also used as a shape of the protruding portion. Further, electrode structures of the X electrode 14 and the Y electrode 15 are not limited to the shape illustrated in FIG. 1, and such a structure, so-called ALIS (Alternate Lighting of Surface Method) may be provided that, for example, these display electrode pairs are arranged so as to have equal interval therebetween, so that all of the intervals between the X electrode 14 and the Y electrode 15 adjacent to each other become the display lines.

These electrode groups (X electrode 14 and Y electrode 15) are covered by a dielectric layer 17 mainly made of a glass material such as $SiO_2$. There is performed a step of forming the dielectric layer 17 so as to cover the display electrode pair, for example, as follows. That is, the dielectric layer 17 is formed by, for example, coating a frit paste having a low melting point glass powder as a main component on the front plate 13 with using screen printing method and baking it. Besides, the dielectric layer 17 can be also formed by a method of attaching a sheet-like dielectric sheet so-called green sheet and baking it. Or, the dielectric layer 17 may be formed by depositing a $SiO_2$ film with using plasma CVD method.

On the inward surface of the dielectric layer 17, a protective film 18 for protecting the dielectric layer 17 from bombardment due to ion impact caused by discharge (mainly, sustain discharge) in the display is formed. Therefore, the protective film 18 is formed so as to cover a surface of the dielectric layer 17. The protective film 18 is formed of an MgO (magnesium oxide) film 18*a* laminated on the surface of the dielectric layer 17 and a plurality of MgO crystalline particles 18*b* attached on the MgO film 18*a* as illustrated in FIG. 2. A structure and a function of the protective film 18 and a step of forming the protective film 18 on the surface of the dielectric layer 17 will be described in detail later.

Meanwhile, the back plate structure 12 includes a back plate 19 formed of, for example, a glass plate. On a surface (inward surface) of the back plate 19 facing the front plate structure 11, a plurality of address electrodes 20 are formed. Each address electrode 20 is formed so as to extend along a column direction DY intersecting (substantially crossing at right angle) with the extending directions of the X electrode 14 and the Y electrode 15. Also, address electrodes 20 are arranged at a predetermined arrangement interval therebetween so as to be in substantially parallel with each other.

As a material forming the address electrode 20, for example, Ag, Au, Al, Cu, Cr, their stacked layer (for example, a stacked layer of Cr/Cu/Cr), or the like can be used, similarly to the X bus electrode 14*b* and the Y bus electrode 15*b*. Also, by using a thick film formation technique or a thin film formation technique such as vapor deposition method or sputtering method with etching technique depending on the material used for the address electrode 20, the address electrode 20 with a predetermined number of lines, thickness, width, and interval can be formed.

The address electrode 20 and the Y electrode 15 formed on the front plate structure 11 configure an electrode pair for causing the address discharge which is a discharge for selecting ON or OFF of a cell 25. That is, the Y electrode 15 has both functions of a sustain discharge electrode and an address discharge electrode (scan electrode).

The address electrode 20 is covered by a dielectric layer 21. The dielectric layer 21 can be formed by using the same material and the same method with those of the dielectric layer on the front plate 13. A plurality of barrier ribs 22 extending in a thickness direction of the back plate structure 12 are formed on the dielectric layer 21.

A front surface (inward surface) side of the back plate 19 is partitioned by the barrier ribs 22 into a plurality of discharge spaces 24. As illustrated in FIG. 1, the lattice-like partitioned arrangement structure of the barrier ribs 22 into the discharge spaces 24 in each cell 25 is called a box structure. The arrangement structure of the barrier ribs 22 may be not only the box rib structure but also a structure called stripe rib structure partitioned in strip shape in each cell 25 along the column direction DY in which the address electrode 20 extends.

The barrier ribs 22 can be formed by a step of sandblasting method, photo etching method, or the like. For example, in the sandblasting method, a frit paste containing a low melting point glass frit, a binder resin, a solvent, and the like is coated on the dielectric layer 21 and is dried, and then, a cutting powder is sprayed on the frit paste layer with a state of providing a cutting mask having opening portions for a barrier rib pattern on the layer to cut and remove the frit paste layer exposed at the opening portion of the mask, and the residual layer is baked, so that the barrier ribs 22 are formed. Also, in the photo etching method, instead of cutting and removing by the cutting powder, a photosensitive resin is used for the binder resin, and exposure with using a mask and development are performed, and then, the residual layer is baked, so that the barrier ribs 22 are formed.

At respective predetermined positions on a top surface of the dielectric layer 21 on the address electrode 20 and side surfaces of the barrier ribs 22, there are formed phosphors 23*r*, 23*g*, and 23*b* to be excited by vacuum ultraviolet rays to generate visible light of respective colors of red (R), green (G), and blue (B). A step of forming the phosphors 23*r*, 23*g*, and 23*b* in regions partitioned by the barrier ribs 22 is performed, for example, as follows. First, respective phosphor pastes containing phosphor powder having luminous characteristics of respective colors, a binder resin, and a solvent are prepared. The phosphor pastes are coated in the discharge space partitioned by the barrier ribs with using screen printing method, a method of using a dispenser, or the like, the manner is repeated for respective color (luminous color), and then, the phosphor pastes are baked, so that phosphors 23*r*, 23*g*, and 23*b* are formed.

Also, the phosphors 23*r*, 23*g*, and 23*b* can be formed by photolithography technique with using a sheet-like phosphor layer material (so-called green sheet) containing phosphor powder, a photosensitive material, and a binder resin. In this case, exposure and development are performed with sticking a predetermined color sheet on whole surface of the display region on the plate, and the manner is repeated in respective color, so that the phosphor 23 of respective color can be formed between the corresponding barrier ribs 22.

Also, in each discharge space 24, a gas called discharge gas such as rare gas is filled with a predetermined pressure. As the discharge gas, a mixture gas such as Xe—Ne in which partial pressure ratio of Xe is adjusted to, for example, several percentage to several tens of percentage can be used.

The PDP 1 is obtained by assembling the back plate 19 and a surface on which the above-described display electrode pair of the front plate 13 so as to oppositely arrange to each other with interposing the discharge space 24 therebetween. The assembly step includes: an alignment step of the front plate 13 with the back plate 19; a sealing step for sealing a periphery portion between each plate (front plate 13 and back plate 19) by using, for example, a low melting point glass material called seal frit; a step for exhausting a residual gas from internal space of the PDP 1 and filling the discharge gas therein; and the like.

In the PDP 1, one cell 25 is formed so as to correspond to the intersection of the address electrode 20 and the paired X electrode 14 and Y electrode 15. That is, the cell 25 is formed in each intersection of the address electrode 20 and the display electrode pair (pair of X electrode 14 and Y electrode 15). An area size of the cell 25 is determined by the arrangement interval of the paired X electrode 14 and Y electrode 15 and the arrangement interval of the barrier rib 22. Also, in each cell 25, there is formed any one of the red phosphor 23*r*, the green phosphor 23*g*, and the blue phosphor 23*b*.

A pixel is configured by a set of respective cells 25 of R, G, and B. That is, the respective phosphors of 23*r*, 23*g*, and 23*b* are luminous elements of the PDP 1, and the phosphors are excited by vacuum ultraviolet rays having a predetermined wavelength generated by the sustain discharge to emit visible light of respective colors of red (R), green (G), and blue (B).

Note that, although the example of forming the address electrodes 20 on the back plate structure 12 is illustrated in FIG. 1, the address electrodes 20 can be also formed on the front plate structure 11. In this case, the dielectric layer 17 illustrated in FIG. 1 has a multilayer structure, and its first dielectric layer covers the display electrode pair, and the address electrode 20 can be formed between its first and second dielectric layers.

<Entire Configuration of PDP Module and Driving Method Thereof>

Figure 3:
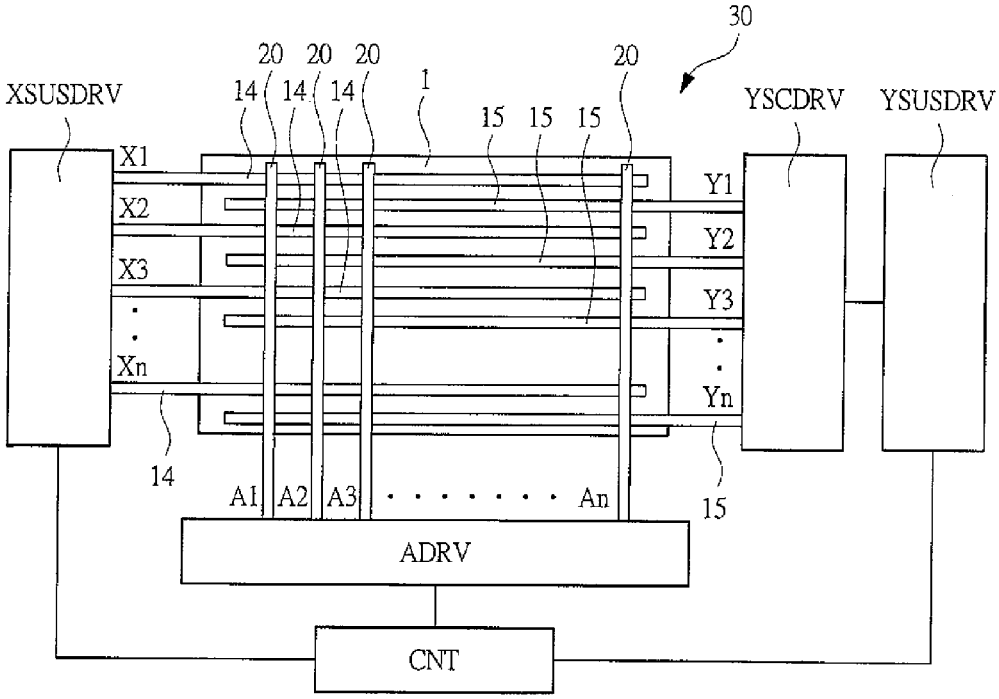
FIG. 3 is a block diagram schematically illustrating an entire configuration of a PDP module in which the PDP illustrated in FIG. 1 is installed.
Figure 4:
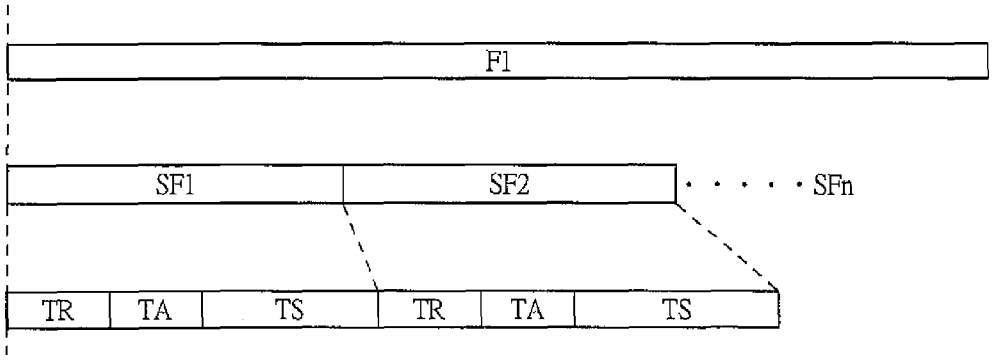
FIG. 4 is an explanatory diagram showing one example of a grayscale driving sequence in the PDP module illustrated in FIG. 3.
Figure 5:
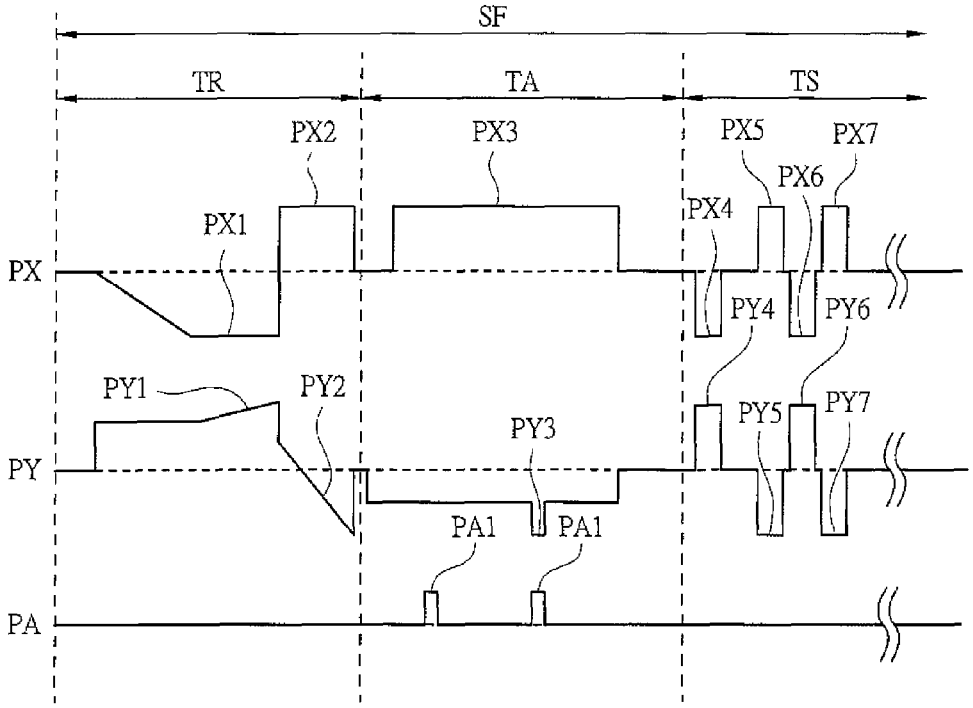
FIG. 5 is an explanatory diagram showing one example of driving waveforms in the PDP module illustrated in FIG. 3.

Next, one example of a driving method of the PDP module in which the PDP 1 illustrated in FIG. 1 is installed will be described with reference to FIGS. 3 to 5. FIG. 3 is a block diagram schematically illustrating an entire configuration of the PDP module in which the PDP illustrated in FIG. 1 is installed. Also, FIG. 4 is an explanatory diagram showing one example of a grayscale driving sequence in the PDP module illustrated in FIG. 3, and FIG. 5 is an explanatory diagram showing one example of driving waveforms in the PDP module illustrated in FIG. 3.

In FIG. 3, the PDP 1 installed in a PDP module 30 is configured with X electrodes 14, Y electrodes 15, address electrodes 20, and so forth. Also, for applying voltage across respective electrodes (X electrode 14, Y electrode 15, and address electrode 20), an address driving circuit ADRV, a Y scan driver YSDRV, a Y driving circuit YSUSDRV, and an X driving circuit XSUSDRV are electrically connected to the PDP module 30. Further, the PDP module 30 includes a controlling circuit CNT for controlling each driving circuit (driver).

In the PDP 1, the X electrodes (X1, X2, X3, . . . Xn) 14 and the Y electrodes (Y1, Y2, Y3, . . . Yn) 15 which cause the sustain discharge (display discharge) are alternately arranged to configure the display lines, and matrix-like cells are formed at respective intersections of the display electrode pairs configured with the paired X electrodes 14 and Y electrodes 15 and the address electrodes (A1, A2, A3, . . . An) 20 substantially crossing at right angle with the display electrode pairs (display lines).

In an address process TA (see FIG. 4), the Y scan driver YSDRV controls voltage to sequentially select the Y electrodes (display lines) 15 and generates the address discharge for selecting ON or OFF of the cell corresponding to each of subfields SF1 to SFn (see FIG. 4), between each Y electrode 15 and the address electrode 20 electrically connected to the address driving circuit ADRV.

Also, in a display process TS (see FIG. 4), the Y driving circuit YSUSDRV and the X driving circuit XSUSDRV generate the sustain discharges for the number of times corresponding to brightness weight of each subfield to a cell selected by the address discharge.

Further, the controlling circuit CNT assumes a role of, for example, receiving image data or signal inputted from an external device such as a TV tuner or a computer and outputting proper control signal for each driving circuit (driver) to perform a predetermined image display.

Still further, as illustrated in FIG. 4, in the grayscale driving sequence in the PDP module 30, one field (frame) F1 is configured with the plurality of subfields (subframes) SF1 to SFn each having a predetermined brightness weight, and a desired grayscale display is performed by the combinations of respective subfields SF1 to SFn.

A configuration example of the plurality of subfields is described such that, for example, 256-grayscale display is performed by eight subfields SF1 to SF8 each having a brightness weight of a power of two (ratio of each number of times of the sustain discharge is 1:2:4:8:16:32:64:128). Note that it is needless to say that various combinations of the number of the subfields and the brightness weight of the subfields are possible.

Also, each of the subfields SF1 to SFn is configured with: a reset process (reset period) TR for uniforming wall charges of all of cells in the display region; the address process (address period) TA for selecting the ON cell; and the display process (sustain discharge period) TS for making the selected cell discharge (turn on) for the number of times depending on luminance (brightness weight of each subfield), and the cell is turned on depending on the luminance in each display of each subfield, so that one field display is performed by, for example, displaying eight subfields (SF1 to SF8).

Next, FIG. 5 shows an example of driving waveforms (PX, PY, and PA) applied to respective electrodes (X electrode 14, Y electrode 15, and address electrode 20) illustrated in FIG. 1 in each of the subfields SF1 to SFn illustrated in FIG. 4.

First, in the reset process TR as a first step, reset discharge is generated between the X electrode 14 (see FIG. 1) and the Y electrode 15 (see FIG. 1), so that charges (wall charges) are formed in all of the cells, thereby performing reset (making ready for the next address operation period) of all of the cells.

In the reset process TR, for example, a positive Y writing slope pulse PY1 is applied to the Y electrode 15 and a negative X voltage PX1 is applied to the X electrode 14 as illustrated in FIG. 5, the X electrode 14 and Y electrode 15 configuring the display electrode pair of the PDP 1, respectively. Thereby, the X electrode 14 becomes a cathode and the Y electrode 15 becomes an anode, and the reset discharge is generated between the electrodes, so that the wall charges are formed in all of the cells.

Subsequently, a Y compensating slope pulse PY2 and an X compensating voltage PX2 for erasing the wall charges formed in the cells leaving requisite amounts are applied to the respective electrodes. Thereby, the amounts of the wall charges formed in all of the cells are substantially uniformed. At this time, the wall charges formed in all of the cells may be requisite charged amounts for generating the address discharge in the address process TA. Therefore, in the display process TS described later, the requisite charged amounts of the wall charges are smaller than those for generating the sustain discharge.

In this manner, in the reset process TR, gentler waveforms such as the Y writing slope pulse PY1 and the X voltage PX1 as compared to repetitive sustain pulses PX5, PX6, PX7, PY5, PY6, and PY7 described later are applied as voltage waveforms for generating the reset discharge, so that it can be prevented that the reset discharge goes into an excessive discharge state.

Next, in the address process TA as a second step, the address discharge is generated between the address electrode 20 (see FIG. 1) and the Y electrode 15 for a cell to be selected to turn on to select ON or OFF of the cells. Also, the discharges (sustain discharge and display discharge) in the display electrode (X electrode 14 and Y electrode 15) pair following the address discharge are generated.

In the address process TA, for example, a scan pulse PY3 is applied to the Y electrode 15 and an X voltage PX3 is applied to the X electrode 14 for causing discharge of sequentially determining a cell to be displayed toward the row direction as illustrated in FIG. 5. The scan pulse PY3 is applied so as to delay the timing in each row.

In the present embodiment, so-called address writing method that the address discharge is generated in the ON-selected cell is used. Therefore, wall charges having the requisite charged amounts for generating the sustain discharge are formed in the cells to which the address discharge has generated in the display process TS described later.

On the other hand, an address pulse PA1 is applied to the address electrode 20 for causing discharge for determining a cell to be displayed in the column direction. The address pulse PA1 is applied in accordance with the scan pulse PY3 applied in each row and at a timing of generating the discharge in the cell to be displayed which is formed at the intersection of the Y electrode 15 and the address electrode 20.

Note that, since the address electrode 20 is arranged so as to intersect with the Y electrode 15 as illustrated in FIG. 3, the address pulse PA1 is applied to the address electrode 20 in each application of the scan pulse PY3 to each Y electrode 15. That is, depending on the number of times of applications of the scan pulse PY3 to each Y electrode 15, the address pulse PA1 is applied to the address electrode 20 more than once.

Next, in the display process TS as a third step, the sustain discharge (display discharge) is sustained between the X electrode 14 and the Y electrode 15 of the ON-selected cell to make the cell emit light during a predetermined time period.

In the display process TS, for example, first sustain pulses PX4 and PY4 each having opposite electric polarity to each other are applied to the X electrode 14 and the Y electrode 15, respectively, as illustrated in FIG. 5. Thereby, the discharge state between the display electrode pair is sustained.

Subsequently, the repetitive sustain pulses PX5, PX6, PX7, PY5, PY6, and PY7 having electric polarities opposite to each other are repetitively applied to the X electrode 14 and the Y electrode 15, so that the discharge state between the display electrode pair is further sustained.

As illustrated in FIG. 5, electric polarities of the sustain pulses PX4, PX5, PX6, and PX7 and those of the sustain pulses PY4, PY5, PY6, and PY7 are alternately switched. That is, the X electrode 14 and the Y electrode 15 alternately become the cathode and the anode in the sustain discharge to cause the repetitive discharges.

Although examples of the entire configuration of the PDP device of the present embodiment and the grayscale driving method thereof have been described above, it is needless to say that there are various modification examples. For example, in the driving waveforms described in FIG. 5, the electric polarity of the applied pulse or voltage may be inverted. In this case, in the reset process TR illustrated in FIG. 5, the X electrode 14 becomes the anode and the Y electrode 15 becomes the cathode. Also, for example, voltage waveforms for erasing the wall charges may be added at the end of the display process TS in addition to the driving waveforms illustrated in FIG. 5. Further, as the address discharge method, so-called address erasing method that the address discharge is generated in the OFF-selected cell can be used. In this case, in the reset process TR, the wall charges of the requisite charged amounts for causing the sustain discharge in all of the cells are formed, and the wall charges are erased in each cell by the address discharge.

<Detailed Structure of Protective Layer and Function Thereof>

Next, a detailed structure of the protective layer 18 illustrated in FIGS. 1 to 2 and a function thereof will be described. In FIG. 2, the protective film 18 includes the MgO film 18*a* laminated on the surface of the dielectric layer 17 and the plurality of MgO crystalline particles 18*b* attached on the MgO film 18*a*. The MgO crystalline particle 18*b* is a single crystalline particle of MgO, and each particle has, for example, a cubic shape. Note that the MgO crystalline particles 18*b* attached on the MgO film 18*a* may have one particle being independently attached as illustrated in FIG. 2 and have a plurality of particles being attached in aggregated state. In the present embodiment, the MgO crystalline particles 18*b* are attached in mixed state of the cases.

A function of emitting secondary electrons to accelerate growth and sustaining of the discharge together with a function of preventing deterioration of the dielectric layer 17 due to the ion bombardment in the discharge are required for the MgO film 18*a*. Therefore, MgO having high secondary electron emission coefficient is used for the MgO film 18*a*.

Also, the MgO crystalline particles 18*b* attached on the MgO film 18*a* have a function of supplying more priming electrons (initial charged particles) to the discharge space 24, the priming electron being pilot light (priming) of the discharge when the address discharge, the display discharge, or the like is caused. That is, by attaching the plurality of MgO crystalline particles 18*b* on the MgO film 18*a*, the priming electrons in the discharge space 24 can be increased. By increasing the priming electrons in the discharge space 24, a time from applying the voltage for the discharge to starting the discharge can be shortened. For example, in the case of the address discharge, a time from applying the voltage across the address electrode 20 and the Y electrode 15 illustrated in FIG. 1 to starting the address discharge can be shortened, so that the discharge delay in the address discharge can be shortened.

By the way, while (111) orientation having a secondary electron emission coefficient higher than that of (100) orientation is generally used as a crystal orientation of the MgO film 18*a*, (110) orientation is used in the present embodiment. Hereinafter, problematic points in a case of using (111) orientation as the crystal orientation of the MgO film and its solution will be sequentially described in line with the history of studies made by the present inventors.

The present inventors, first, have produced a PDP module of the comparative example 1 of using (111) orientation as the crystal orientation of the MgO film 18*a* illustrated in FIG. 2. A measurement test of the address voltage (requisite potential of the address pulse for generating the address discharge) has been conducted for the PDP module of the comparative example 1, and it has been found out that a difference in requisite voltage amount between address voltages (address voltage change amount) is significantly large, the address voltages being applied at an initial stage of the address operation (more specifically, an initial stage of a scanning in which pulses are sequentially applied) and applied at a later stage of the address operation (more specifically, a last stage in which pulses are sequentially applied).

It is considered that this phenomenon is caused by the following reason. That is, in the address process TA illustrated in FIG. 5, the address pulse PA1 is applied to the address electrode 20 more than once depending on the number of times of applying the scan pulse PY3 to each Y electrode 15. Here, if the scan pulse PY3 is not applied even if the address pulse PA1 is applied, the discharge is not generated in its design. However, by attaching the plurality of MgO crystalline particles 18*b* on the MgO film 18*a* as illustrated in FIG. 2, the amount of the priming electrons in the discharge space 24 are increased as described above. Since it is easy to generate the discharge when the priming electrons are increased, undesired weak discharge occurs. More particularly, if the address pulse PA1 is applied to the address electrode 20 even if the scan pulse PY3 is not applied, the weak discharge may be generated.

In this manner, when the undesired weak discharge occurs, the wall charges formed for generating the address discharge are decreased. As a result, for generating the address discharge with a state of wall-charge shortage, it is required to apply the higher address pulse PA1. More particularly, in a cell in the latter part of a long period until applying the scan pulse PY3 (called address stand-by time), the address pulse PA1 is applied more than once before applying the scan pulse PY3, and therefore, it is easy to decrease the wall charges.

Accordingly, the present inventors have studied about a technique of suppressing the decrease of the wall charges when the undesired weak discharge occurs for suppressing the increase of the address voltage change amount, and as a result, they have found out that occurrence of the weak discharge can be suppressed by using (110) orientation as the crystal orientation of the MgO film 18*a* illustrated in FIG. 2.

Figure 6:
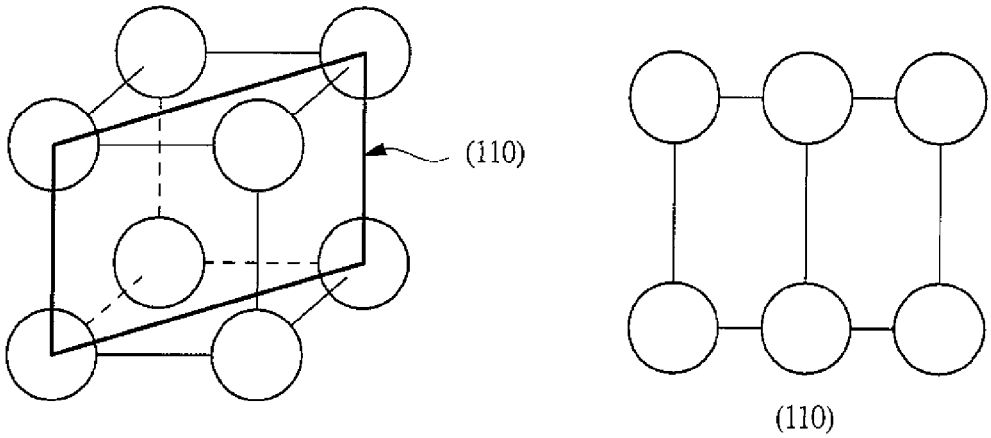
FIG. 6 is a diagram for explaining a crystal structure of an MgO film according to one embodiment of the present invention and is a model diagram illustrating a crystal structure of (110) orientation.
Figure 7:
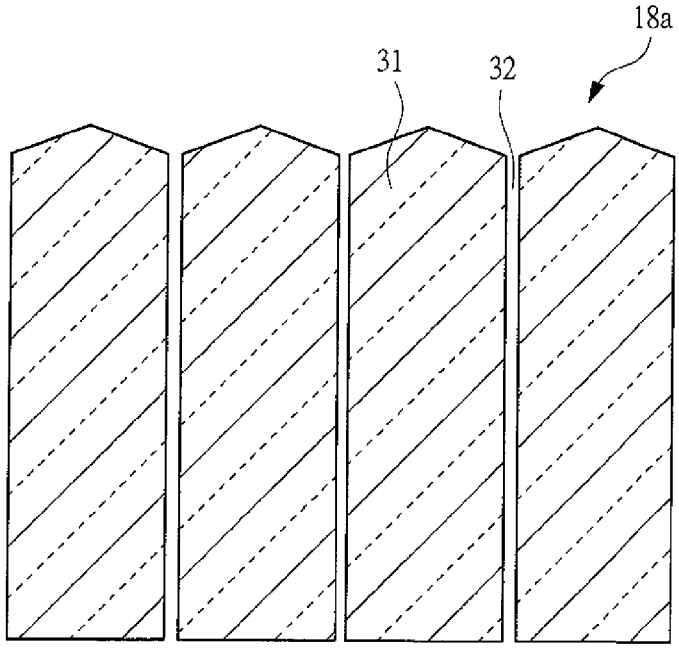
FIG. 7 is a diagram for explaining the crystal structure of the MgO film according to one embodiment of the present invention and is an enlarged cross-sectional view illustrating an image of a cross section of the MgO film.
Figure 8:
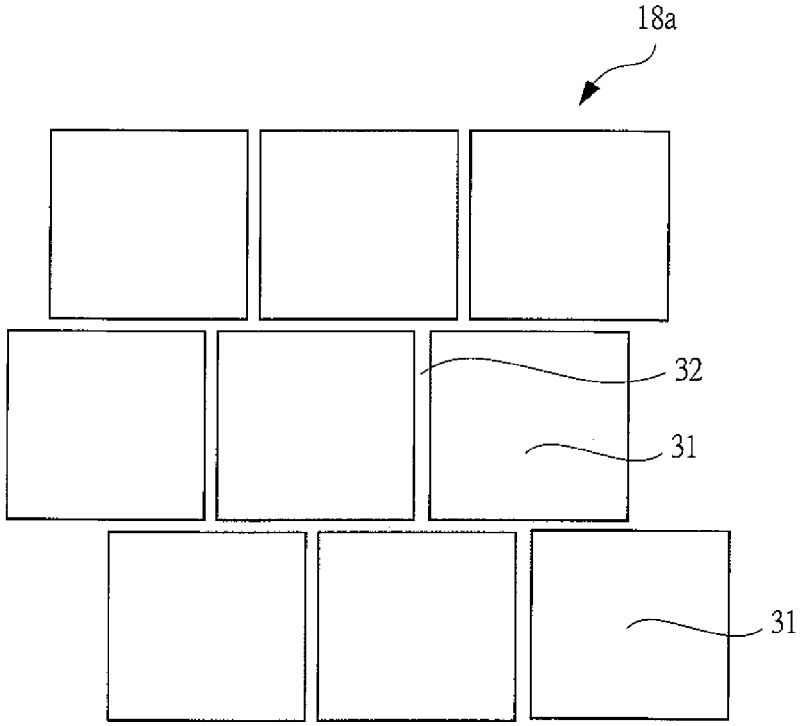
FIG. 8 is an enlarged plan view illustrating an image of a surface of the MgO film illustrated in FIG. 7.
Figure 9:
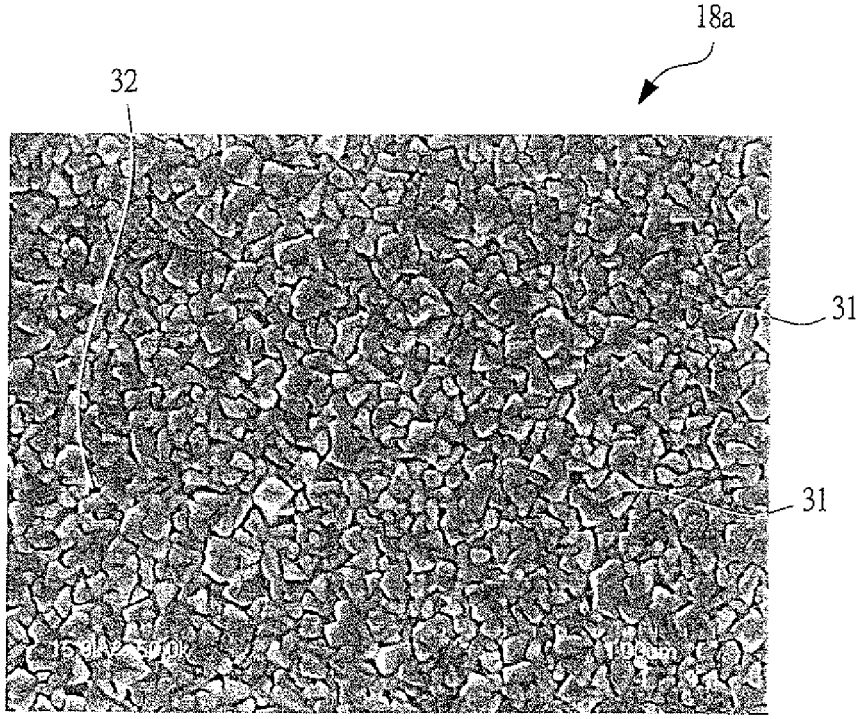
FIG. 9 is an enlarged plan view showing an image of a part of the surface of the MgO film illustrated in FIG. 8 taken by scanning electron microscope.

FIGS. 6 to 9 are diagrams for explaining a crystal structure of the MgO film 18*a* according to the present embodiment, and FIG. 6 is a model diagram illustrating a crystal structure of (110) orientation, FIG. 7 is an enlarged cross-sectional view illustrating an image of a cross section of the MgO film 18*a*, FIG. 8 is an enlarged plan view illustrating the image of the surface of the MgO film 18*a* illustrated in FIG. 7, and FIG. 9 is an enlarged plan view showing an image of a part of the surface of the MgO film 18*a* illustrated in FIG. 8 taken by scanning electron microscope (SEM). On the other hand, FIGS. 14 to 17 are diagrams for explaining a crystal structure of an MgO film of a comparative example to the present embodiment, and FIG. 14 is a model diagram illustrating a crystal structure of (111) orientation, FIG. 15 is an enlarged cross-sectional view illustrating an image of a cross section of the MgO film, FIG. 16 is an enlarged plan view illustrating an image of a surface of the MgO film illustrated in FIG. 15, and FIG. 17 is an enlarged plan view showing an image of a part of the surface of the MgO film illustrated in FIG. 16 taken by SEM.

Figure 14:
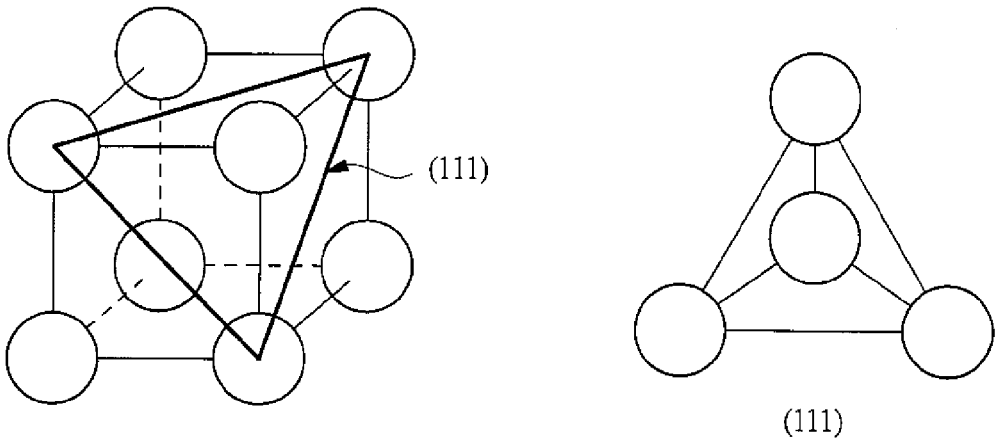
FIG. 14 is a diagram for explaining a crystal structure of an MgO film of the comparative example to the one embodiment of the present invention and is a model diagram illustrating a crystal structure of (111) orientation.
Figure 15:
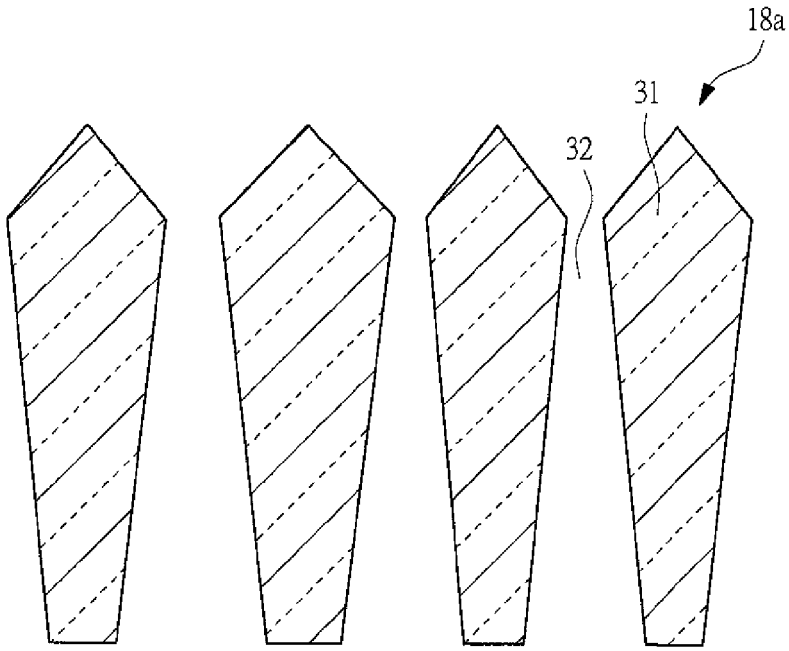
FIG. 15 is a diagram for explaining the crystal structure of the MgO film of the comparative example to the one embodiment of the present invention and is an enlarged cross-sectional view illustrating an image of a cross section of the MgO film.
Figure 16:
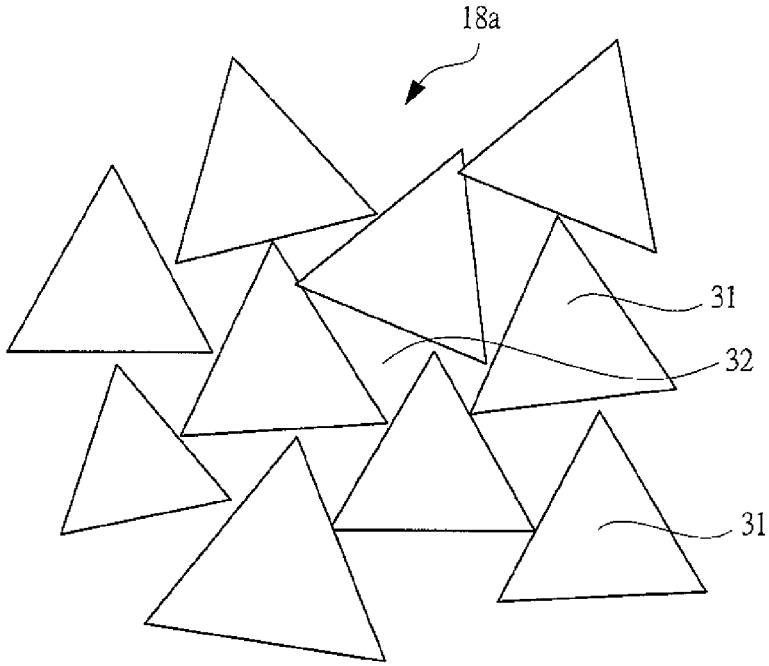
FIG. 16 is an enlarged plan view illustrating an image of a surface of the MgO film illustrated in FIG. 15.
Figure 17:
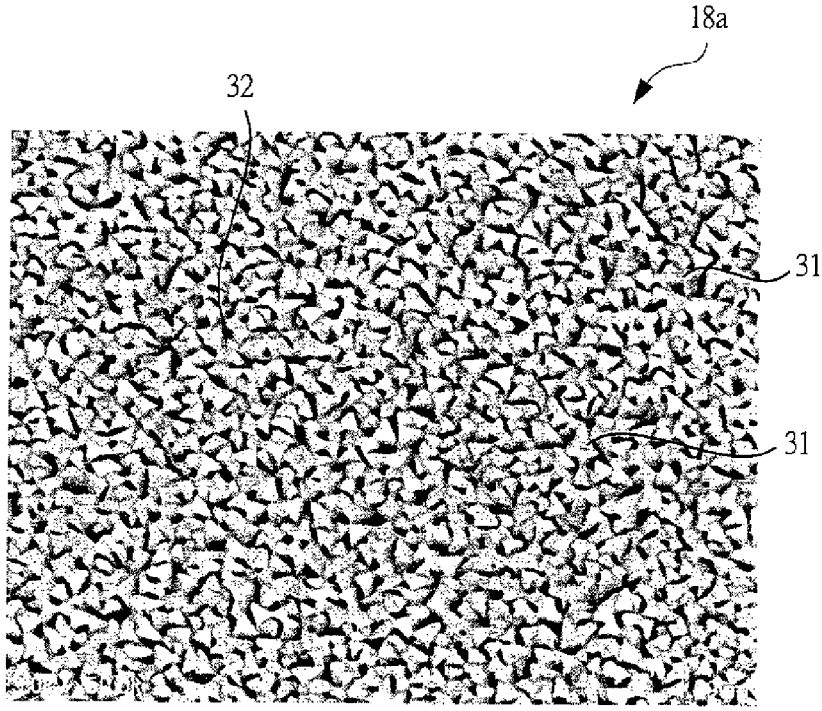
FIG. 17 is an enlarged plan view showing an image of a part of the surface of the MgO film illustrated in FIG. 16 taken by scanning electron microscope.

The (111) orientation has a triangular pyramid crystal structure as illustrated in FIG. 14, and when crystals of (111) orientation are grown, a lot of spaces 32 are formed among respective pillar-shaped crystals 31 as illustrated in FIGS. 15 to 17. On the other hand, the (110) orientation has a triangular prism crystal structure as illustrated in FIG. 6, and when crystals of (110) orientation are grown, the spaces 32 among respective pillar-shaped crystals 31 can be small as illustrated in FIGS. 7 to 9 as compared to the case of (111) orientation. That is, density of respective pillar-shaped crystals 31 (called crystal density) can be improved.

Here, from the point of view of forming the wall charges on the MgO film 18*a* illustrated in FIG. 2 and holding the wall charges there, it is preferable to improve the crystal density. That is, in the present embodiment, the decrease of the wall charges can be suppressed by using (110) orientation as the crystal orientation of the MgO film 18*a* even if the undesired weak discharge occurs. Therefore, the increase of the address voltage change amount required for generating the address discharge can be suppressed.

By the way, when (110) orientation is used as the crystal orientation of the MgO film 18*a*, its secondary electron emission coefficient is lowered as compared with the case of (111) orientation. However, in the present embodiment, the plurality of MgO crystalline particles 18*b* are attached on the MgO film 18*a*, and therefore, the priming electrons are increased. Also, secondary electrons are emitted also from the MgO crystalline particles 18*b*, and therefore, the secondary electron emission coefficient can be improved as compared with the protective film 18 without the MgO crystalline particles 18*b*.

Note that, although the orientation of the surface of the MgO film 18*a* has mainly (110) surface, such an embodiment is not eliminated that the surface of the MgO film 18*a* has an orientation surface other than (110) surface. However, according to the studies made by the present inventors, it has been found out that the address voltage change amount changes depending on temperature of the PDP 1 in the MgO film 18*a* having a lot of the orientation surface other than (110) surface. Hereinafter, detail of the temperature dependency of the address voltage change amount and its solution will be described.

<Temperature Dependency of Address Voltage Change Amount>

The present inventors have found out that the increase of the address voltage change amount can be suppressed by using (110) orientation as the crystal orientation of the MgO film 18*a* when the temperature of the PDP 1 is room temperature of 25° C. However, it has been found out that the address voltage change amount increases as the temperature of the PDP 1 increases. Also, it has been found out that degree of the increase of the address voltage change amount changes depending on a ratio of a crystal surface other than (110) surface included in the MgO film 18*a* or a ratio of impurities contained in the MgO film 18*a*.

FIG. 10 is an explanatory diagram showing a measurement result of the temperature dependency of the address discharge voltage in each example and a comparative example 1 according to the present embodiment. In each of the examples 1 to 5 in FIG. 10, the ratio of the crystal surface other than (110) surface included in the MgO film 18*a* or the ratio of Si which is the impurity contained in the MgO film 18*a* is changed.

The ratio of the crystal surface other than (110) surface included in the MgO film 18*a* can be evaluated by using X-Ray Diffractometer (XRD). That is, X-ray diffraction signal intensity of the protective layer 18 is measured to evaluate the ratio by comparison of a signal intensity of (220) surface and a signal intensity of (200) surface. Note that, (220) surface is equivalent to (110) surface and (200) surface is equivalent to (100) surface, and the signal intensity of (220) surface is strong when the crystal orientation of the MgO film 18*a* is uniformed in (110) surface. Also, the MgO crystalline particle 18*b* is a single crystalline particle and has (100) surface. Therefore, the signal of (200) surface is mainly a signal from the MgO crystalline particle 18*b*.

Further, the comparison of the signal intensity of (220) surface and the signal intensity of (200) surface is a comparison of a value of the peak intensity of (220) surface normalized by a thickness of the MgO film 18*a* and a value of the peak intensity of (200) surface normalized by the coverage ratio of the plurality of MgO crystalline particles 18*b* on the MgO film 18*a*. Since the signal intensity of (220) surface is influenced by the thickness of the MgO film 18*a* and the signal intensity of (200) surface is influenced by the coverage ratio of the MgO film 18*a*, these factors are eliminated to use the values as an index for evaluating the ratio of the crystal surface other than (110) surface included in the MgO film 18*a*.

More specifically, a value $P_{220}$ of "the peak intensity of (220) surface/the thickness of the MgO film (unit: μm)" and a value $P_{200}$ of "the peak intensity of (200) surface/the coverage ratio" are compared, and the comparison result $P_{220}/P_{200}$ is illustrated in FIG. 10. Here, "coverage ratio" means, when observed from a vertical direction for the surface of the MgO film 18*a* on which the MgO crystalline particles 18*b* are dispersed, a ratio of an area size of the MgO crystalline particles 18*b* to an area size of the MgO film 18*a* which is a base of the MgO crystalline particles 18*b*. In the present embodiment, the coverage ratio in a field of view of a square of 0.6 mm×0.6 mm is measured at each of a plurality of measurement points, and, for example, the measurement is conducted at ten measurement points each linearly having 10 mm interval to the other. The field of view of the square of 0.6 mm×0.6 mm is set as a particularly preferable area with regard to a relation of cumulative particle size distribution of the MgO crystalline particles and measurement accuracy of the coverage ratio. Also, the number of the measurement points and the measurement interval are not particularly limited. However, for improving the accuracy, it is preferable to measure at, at least, ten measure points or more.

Further, in FIG. 10, an address voltage change amount at 25° C. is indicated by Va1 and an address voltage change amount at 60° C. is indicated by Va2, and a temperature dependency change amount expressed by "Va2-Va1" is indicated by ΔVa. Note that, a reason that the Va2 value is a value at 60° C. in the PDP 1 is because an average temperature in high temperature range is about 60° C. in consideration of an achieving temperature of a PDP when the PDP 1 is actually driven.

Still further, in FIG. 10, a concentration of Si (silicon) which is the impurity contained in the MgO film 18*a* is indicated by Si concentration. In a measurement of the concentration of Si contained in the MgO film 18*a*, results measured by secondary ion mass spectrometry (SIMS) are illustrated.

In FIG. 10, when the examples 1 to 3 are compared with each other, it is found that ΔVa becomes small as the value of $P_{220}/P_{200}$ becomes large. For example, in the example 1, while its Va1 is 20.7 V which is lower than 22.1 V of the comparative example 1, its ΔVa is 25.5 V which is very high, and therefore, its Va2 is significantly higher than that of the comparative example 1 in the high temperature range.

However, the value of ΔVa is improved by obtaining a large value of $P_{220}/P_{200}$ that is, uniforming the crystal orientation of the MgO film 18*a* in (110) orientation. When the value of $P_{220}/P_{200}$ is 0.8 as denoted in the example 2, its Va2 value can be improved to be about 1 V lower than that of the comparative example 1. Further, in the example 3 in which the value of $P_{220}/P_{200}$ is 1, its ΔVa value is also smaller than that of the comparative example 1, and as a result, the address voltage change amount Va2 can be significantly improved also in the high temperature range.

Note that, the same tendency of the phenomenon that ΔVa becomes small as the value of $P_{220}/P_{200}$ becomes large can be seen in a case of changing (thinning) the Si concentration in the MgO film 18*a*, and when the example 4 and the example 5 are compared, a ΔVa value of the example 5 having the larger value of $P_{220}/P_{200}$ is smaller than that of the example 4.

In this manner, it is considered that a phenomenon in which ΔVa becomes small as the value of $P_{220}/P_{200}$ becomes large is caused by the following reason. The large value of $P_{220}/P_{200}$ means that the crystal orientation of respective pillar-shaped crystals 31 (see FIG. 7) configuring the MgO film 18*a* is uniformed in (110) orientation. Therefore, the crystal density of the MgO film 18*a* becomes high. Also, the crystal structure of respective pillar-shaped crystals 31 illustrated in FIG. 7 is also stabilized by uniforming the crystal orientation in (110) orientation. When the temperature of the PDP 1 is increased, it is easy to emit the wall charges formed on the MgO film 18*a* by thermal influence. However, when the crystal orientation is uniformed in (110) orientation, the crystal density is increased or the crystal structure is stabilized, and as a result, emission of the wall charges by thermal influence can be suppressed even if the temperature of the PDP 1 is increased.

Next, a relation of the temperature dependency of the address voltage change amount and the Si concentration in the MgO film will be described. From the comparison of the example 1 and the example 4 and the comparison of the example 3 and the example 5 illustrated in FIG. 10, it is found that ΔVa value becomes small as the Si concentration becomes low. More specifically, as denoted in the example 4, its Va2 value can be also improved by about 2.5 V compared with that of the comparative example 1 by setting the Si concentration in the MgO film 18*a* to 150 ppm or lower. Also, as denoted in the example 5, its ΔVa value can be further improved compared with that of the example 3 by setting the Si concentration in the MgO film 18*a* to 150 ppm or lower and setting the value of $P_{220}/P_{200}$ to 1 or larger.

In this manner, it is considered that the phenomenon in which the ΔVa becomes small by setting the Si concentration in the MgO film 18*a* to 150 ppm or lower is caused by the following reason. When Si is contained in the MgO film 18*a* as the impurity, for example, Mg is substituted by Si in the crystal structure of the MgO film 18*a*. Since Mg is a divalent positive ion and Si is a tetravalent positive ion, oxygen vacancy is caused by the substitution. The oxygen vacancy assumes a role of a hole to affect impedance of the MgO film 18*a*. Therefore, when the temperature of the PDP 1 becomes high, it is easy to release electrons existing in the hole from binding of Coulomb attraction, and therefore, the impedance of the MgO film 18*a* is lowered. Also, for example, when Si is incorporated into the crystal lattice of the MgO film 18*a*, impurity level is formed in the MgO film 18*a*. The impurity level assumes a role of carrier. Also in this case, when the temperature of the PDP 1 becomes high, it is easy to release the carrier from binding of Coulomb attraction, and therefore, the impedance of the MgO film is lowered.

That is, in the present embodiment, from the point of view of improving high temperature characteristics (phenomenon in which the address discharge voltage Va2 in high temperature region increases), the concentration of Si which is the impurity is reduced to suppress the lowering of the impedance of the MgO film 18*a* at high temperature.

<Method of Forming Protective Layer>

Figure 11:
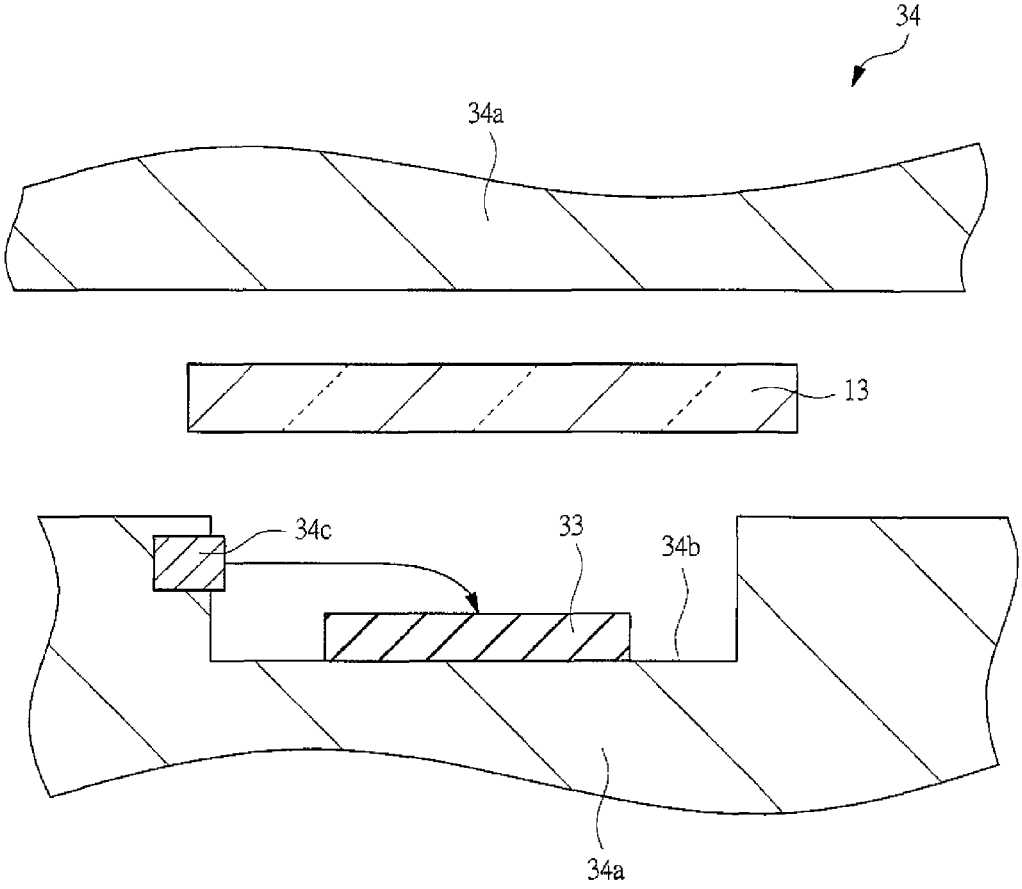
FIG. 11 is a cross-sectional view of a principal part illustrating an outline of a device for forming the MgO film according to one embodiment of the present invention.

Next, a step of forming the protective layer illustrated in FIGS. 1 and 2 will be described. FIG. 11 is a cross-sectional view of a principal part illustrating an outline of a device for depositing the MgO film according to the present embodiment. Also, FIG. 12 is an explanatory diagram showing film deposition conditions of the examples 1 to 5 and the comparative example 1 illustrated in FIG. 10.

A step of forming the protective layer 18 on the surface of the dielectric layer 17 illustrated in FIGS. 1 and 2 includes a step of forming (depositing) the MgO film 18*a* on the surface of the dielectric layer 17 and a step of attaching the plurality of MgO crystalline particles 18*b* on the surface of the MgO film 18*a*.

In the step of forming the MgO film 18*a* on the surface of the dielectric layer 17, as illustrated in FIG. 11, the MgO film 18*a* is formed by so-called vapor deposition method that a target material 33 of MgO which is a deposition material is heated to be vaporized (evaporated) under reduced pressure atmosphere to deposit it on a surface of the front plate 13 (more specifically, surface of the dielectric layer 17 illustrated in FIG. 1).

As illustrated in FIG. 11, a deposition apparatus 34 includes a reduced pressure chamber 34*a*, a crucible 34*b* for placing the target material 33, and a heat source 34*c* for evaporating the target material 33. The heat source 34*c* is, for example, electron gun irradiating electron beam. When the electron beam radiated from the heat source 34*c* is irradiated to the target material 33, the target material 33 in the irradiated region is vaporized (evaporated). Meanwhile, the front plate 13 is arranged above the crucible 34*b* in a state in which the surface of the dielectric layer 17 illustrated in FIG. 1 is faced to the crucible 34*b*, and is passed through above the crucible 34*b*. Thereby, the MgO film 18*a* is formed on the surface of the dielectric layer 17 of the front plate 13.

Here, in a case of forming the MgO film having (111) crystal orientation illustrated as the comparative example 1 in FIG. 10, MgO is vapor-deposited as introducing oxygen gas into the reduced pressure chamber 34*a*. More specifically, entire pressure within the reduced pressure chamber 34*a* in the vapor-deposition of MgO is, for example, about 0.1 Pa to 0.11 Pa, and by setting partial pressure of the oxygen gas of the entire pressure to 0.8 Pa or higher, the MgO film having a crystal structure of (111) orientation as illustrated in FIG. 14 can be relatively stably formed.

On the other hand, in the present embodiment, a first gas except for the oxygen gas is introduced into the reduced pressure chamber 34*a* in the vapor-deposition of MgO. More specifically, in the present embodiment, water vapor is introduced into the reduced pressure chamber 34*a* in the vapor-deposition of MgO. Here, as a result of studies made by the present inventors, the crystal orientation of the formed MgO film 18*a* can be provided so as to have (110) orientation by setting, at least, the partial pressure of oxygen gas within the reduced pressure chamber 34*a* (that is in the reduced pressure atmosphere) to be lower than a partial pressure of the water vapor (first gas) introduced into the reduced pressure atmosphere. Also, as illustrated in FIG. 12, by setting the partial pressure of the water vapor to 0.08 Pa or larger, the value of $P_{220}/P_{200}$ can be 1 or higher, that is, the crystal orientation can be uniformed in (110) orientation.

Note that, in the first embodiment, the MgO film 18*a* is formed by ion plating method. That is, parts of the water vapor introduced into the reduced pressure atmosphere and the evaporated MgO are ionized to crystallize themselves on the surface of the dielectric layer 17 (see FIG. 1). By using the ion plating method, the obtained MgO film 18*a* has more uniformed film quality. Also, in the ion plating method, when water vapor is used as the introduced reactive gas, hydrogen ion and oxygen ion are supplied from the water vapor. The hydrogen ion has an effect of accelerating crystallization of the MgO film 18*a*, and the oxygen ion becomes a source material ion of the MgO film 18*a*, and therefore, water vapor is more preferable as the introduced gas.

By the way, while the target material 33 is formed so as to contain MgO as a main component, the target material 33 contains impurities other than MgO because it is formed by purifying ocean water or mineral. The impurities include above-described Si and, for example, Ca and the like. Here, when the impurities are contained in the target material 33, the impurities are contained also in the deposited MgO film 18*a*. Therefore, for setting the Si concentration in the MgO film 18*a* to 150 ppm or lower, it is preferable to set the Si concentration contained in the target material 33 to 50 ppm or lower as illustrated in FIG. 12. Thereby, the Si concentration in the MgO film 18*a* can be set to 150 ppm or lower.

<About Coverage Ratio of MgO Film>

In the present embodiment, a coverage ratio of the MgO film covered by the MgO crystalline particles 18*b* is 10% or lower because of the following reasons.

As described above, by attaching the plurality of MgO crystalline particles 18*b* on the MgO film 18*a*, priming electrons in the discharge space 24 can be increased. However, according to studies of the present inventors, when the attached amount of the MgO crystalline particles 18*b* is too excessive, abnormality is caused in display colors of the PDP 1. That is, when the MgO crystalline particles 18*b* are attached, a surface area of the MgO crystalline particles 18*b* exposed to the discharge space becomes large as compared with the case of not attaching the MgO crystalline particles 18*b*. MgO has characteristics of easiness of adsorbing impurities such as $CO_2$ and $H_2O$, and there is a case of causing uneven color (so-called uneven red color in the display) that phosphors (more particularly, phosphor having emission property of green) are deteriorated by increase of the impurities in accordance with the increase of the surface area, and therefore, green light emission is weak to increase red color in the display color. Although the phenomenon is practically negligible small when the attached amount of the MgO crystalline particles 18*b* is small, the phenomenon becomes large as the attached amount is increased. As a result of experimental studies about a critical point of the phenomenon made by the present inventors, when the coverage ratio of the MgO film 18*a* is over 10%, the phenomenon is particularly remarkable. Accordingly, in the present embodiment, the attached amount of the MgO crystalline particles 18*b* is reduced, and the coverage ratio of the MgO film 18*a* is set to 10% or lower. Note that, since the description of "coverage ratio" is as explained above, its repetitive description is omitted.

The coverage ratio of the PDP 1 according to the present embodiment is set to 10% or lower in the above-described all fields of view. Also, the coverage ratio in all cells 25 included in the PDP 1 is set to 10% or lower. Therefore, in the PDP 1 according to the present embodiment, the MgO crystalline particles 18*b* are substantially uniformly dispersed.

In this manner, by reducing the attached amount of the MgO crystalline particles 18*b* so as to set the coverage ratio to 10% or lower in all cells 25 included in the PDP 1, the abnormality (uneven red color) of the display color of the PDP 1 can be suppressed.

Also, by setting the coverage ratio to 10% or lower as described above, the exposed surface area of the MgO film 18*a* is relatively increased. Therefore, in the PDP 1 in which the coverage ratio of the MgO film 18*a* is set to 10% or lower like the present embodiment, the crystal structure of the MgO film 18*a* and composition thereof have a great influence on the address voltage change amount.

<About Sputtering Resistance>

As described above, according to the present embodiment, by using (110) orientation as the crystal orientation of the MgO film 18*a*, the crystal density of the MgO film 18*a* can be increased as compared with that of (111) orientation. Therefore, a sputtering resistance of the MgO film 18*a* can be improved.

By the way, for improving luminescent efficiency (ratio of luminescent quantity to input power amount) of the PDP 1, there is a technique of increasing a Xe (xenon) concentration in the discharge gas. Xe ionized by the discharge radiates vacuum ultraviolet rays which are excitation source of phosphors when it traps electrons to transit to ground state. Therefore, by increasing the Xe concentration in the discharge gas, the luminescent efficiency can be improved.

However, when the Xe concentration in the discharge gas is increased, there is a problem of lowering the sputtering resistance of the MgO film. Accordingly, the present inventors have conducted verification experiment for an effect of suppressing the lowering of the sputtering resistance by using (110) orientation as the orientation of the MgO film 18*a*. FIG. 13 is an explanatory diagram showing change of the sputtering rate when each concentration of Xe gas is changed in the PDPs of an example and comparative examples according to the present embodiment.

In FIG. 13, sputtering rates are compared in the comparative example 1 and the example 5 having the smallest address voltage change amount in FIG. 12. In both of the example 5 and the comparative example 1, the Xe concentrations in the discharge gas are set to 18%. Also, in the comparative examples 2 to 5, sputtering rates in a case of using the Xe concentration of 8% are illustrated. Note that, in the comparative examples 2 to 5, the sputtering rates in the state of not attaching the MgO crystalline particles 18*b* illustrated in FIG. 2 are verified for confirming the influences of the crystal orientation of the MgO film and uniformity of the crystal orientation to the sputtering rate. Also, the sputtering rate is illustrated as a relative value using the sputtering rate of the comparative example 2 as a reference value, and a smaller numerical value means harder to sputter.

In the comparative examples 2 to 5, it is found out that the comparative examples 3 to 5 having (110) orientation are lower in the sputtering rate than the comparative example 2 having (111) orientation. Also, in the comparative examples 3 to 5, as a water vapor partial pressure in the film formation is increased (that is, the crystal orientation is uniformed in (110) orientation), the sputtering rate is improved. More particularly, when the water vapor partial pressure is 0.08 Pa as denoted in the comparative example 5, the improvement of the sputtering rate is remarkable, and the sputtering rate can be reduced down to 75% of that of the comparative example 2.

On the other hand, in the comparative example 1 and the example 5, by the influence of the Xe concentration of 18%, both of their sputtering rates are larger than 1. However, the sputtering rate of the example 5 is down to about 66% of that of the comparative example 1. That is, by providing (110) orientation, the increase of the sputtering rate can be suppressed.

As the results illustrated in FIG. 13, by uniforming the crystal orientation of the MgO film 18*a* illustrated in FIG. 2 in (110) orientation, the effect of improving the sputtering rate can be obtained. Also, the effect of improving the sputtering rate is particularly remarkable when the Xe concentration contained in the discharge gas is 18%.

That is, in the PDP according to the present embodiment, even if the discharge gas having the Xe concentration over 10% is filled for improving the luminescent efficiency, the increase of the sputtering rate can be suppressed, so that long lifetime of the PDP can be obtained.

In the foregoing, the invention made by the inventors of the present invention has been concretely described based on the embodiments. However, it is needless to say that the present invention is not limited to the foregoing embodiments and various modifications and alterations can be made within the scope of the present invention.

What is claimed is:

1. A plasma display panel, comprising:

a pair of plate structures disposed opposite to one another, so as to form a discharge space interposed between the plate structures, the discharge space configured to be filled with a discharge gas, and wherein a plate structure includes:

a plurality of display electrode pairs, arranged on a plate, a dielectric layer covering the plurality of display electrode pairs, and a protective layer covering the dielectric layer, the protective layer including:

a magnesium oxide (Mgo) film, having a main crystal orientation of (110) orientation, deposited on a surface of the dielectric layer, and a plurality of Mgo crystalline particles having a (100) crystal orientation, or a combination of a (100) crystal orientation and other crystal orientations, and being attached on the Mgo film; and, wherein when the protective layer is measured for X-ray diffraction signal intensity, a value of a peak diffraction signal intensity of a (220) surface divided by a thickness of the MgO film is expressed as $P_{220}$ in units of μm, a value of a peak diffraction signal intensity of a (200) surface divided by a coverage ratio of the plurality of MgO crystalline particles on the MgO film is expressed as $P_{200}$ in units of μm, and the ratio $P_{220}/P_{200}$ is larger than or equal to 0.8.

2. The plasma display panel according to claim 1, wherein when the protective layer is measured for X-ray diffraction signal intensity, the value of the peak diffraction signal intensity of a (220) surface divided by the thickness of the MgO film is expressed as $P_{220}$ in units of μm, 0.8 times a value of the peak diffraction signal intensity of a (200) surface divided by the coverage ratio of the plurality of MgO crystalline particles on the MgO film is expressed as $P_{200}$ in units of μm, and the ratio $P_{220}/P_{200}$ is larger than or equal to one.

3. The plasma display panel according to claim 1, wherein a coverage ratio of the plurality of Mgo crystalline particles dispersed on a surface of the MgO film is 10% or lower.

4. The plasma display panel according to claim 1, wherein Silicon (Si) is contained in the MgO film as an impurity; and wherein a concentration of the Si in the MgO film is 150 ppm or lower.

5. The plasma display panel according to claim 4, wherein when the protective layer is measured for X-ray diffraction signal intensity, a value of a peak diffraction signal intensity of a (220) surface divided by a thickness of the MgO film is expressed as $P_{220}$ in units of μm, a value of a peak diffraction signal intensity of a (200) surface divided by a coverage ratio of the plurality of MgO crystalline particles on the MgO film is expressed as $P_{200}$ in units of μm, and the ratio $P_{220}/P_{200}$ is larger than or equal to one.

6. The plasma display panel according to claim 5, wherein the coverage ratio of the plurality of Mgo crystalline particles dispersed on a surface of the MgO film is 10% or lower.

7. A plasma display device comprising:

a plasma display panel, including:

a pair of plate structures disposed opposite to one another, so as to form a discharge space interposed between the plate structures, the discharge space configured to be filled with a discharge gas, and wherein a plate structure includes:

a plurality of display electrode pairs, arranged on a plate, a dielectric layer covering the plurality of display electrode pairs, and a protective layer covering the dielectric layer, the protective layer including:

a magnesium oxide (Mgo) film, having a main crystal orientation of (110) orientation, deposited on a surface of the dielectric layer, and a plurality of Mgo crystalline particles, having a (100) orientation as a main crystal orientation, and being attached on the Mgo film; and a circuit for driving the plasma display panel;

wherein when the protective layer is measured for X-ray diffraction signal intensity, a value of a peak diffraction signal intensity of a (220) surface divided by a thickness of the MgO film is expressed as $P_{220}$ in units of μm, a value of a peak diffraction signal intensity of a (200) surface divided by a coverage ratio of the plurality of MgO crystalline particles on the MgO film is expressed as $P_{200}$ in units of μm, and the ratio $P_{220}/P_{200}$ is larger than or equal to 0.8.

8. The plasma display panel according to claim 7, wherein when the protective layer is measured for X-ray diffraction signal intensity, the value of the peak diffraction signal intensity of a (220) surface divided by the thickness of the MgO film is expressed as $P_{220}$ in units of μm, 0.8 times a value of the peak diffraction signal intensity of a (200) surface divided by the coverage ratio of the plurality of MgO crystalline particles on the MgO film is expressed as $P_{200}$ in units of μm, and the ratio $P_{220}/P_{200}$ is larger than or equal to one.

9. The plasma display panel according to claim 7, wherein a coverage ratio of the plurality of MgO crystalline particles dispersed on a surface of the MgO film is 10% or lower.

10. The plasma display panel according to claim 7, wherein Silicon (Si) is contained in the MgO film as an impurity; and wherein a concentration of the Si in the MgO film is 150 ppm or lower.

11. The plasma display panel according to claim 10, wherein when the protective layer is measured for X-ray diffraction signal intensity, a value of a peak diffraction signal intensity of a (220) surface divided by a thickness of the MgO film is expressed as $P_{220}$ in units of μm, a value of a peak diffraction signal intensity of a (200) surface divided by a coverage ratio of the plurality of MgO crystalline particles on the MgO film is expressed as $P_{200}$ in units of μm, and the ratio $P_{220}/P_{200}$ is larger than or equal to one.

12. The plasma display panel according to claim 11, wherein the coverage ratio of the plurality of MgO crystalline particles dispersed on a surface of the MgO film is 10% or lower.

* * * * *